United States Patent [19]

Baba et al.

[11] Patent Number: 4,462,843

[45] Date of Patent: Jul. 31, 1984

[54] METHOD FOR PRODUCING FINE-GRAINED, HIGH STRENGTH ALUMINUM ALLOY MATERIAL

[75] Inventors: Yoshio Baba; Teruo Uno, both of Nagoya, Japan

[73] Assignee: Sumitomo Light Metal Industries, Ltd., Tokyo, Japan

[21] Appl. No.: 355,058

[22] Filed: Mar. 5, 1982

[30] Foreign Application Priority Data

Mar. 31, 1981 [JP] Japan ..... 56-46523

[51] Int. Cl.[3] ..... C22F 1/04

[52] U.S. Cl. ..... 148/11.5 A; 148/12.7 A; 148/417; 148/439

[58] Field of Search ..... 148/11.5 A, 12.7 A, 148/417, 439, 2

[56] References Cited

U.S. PATENT DOCUMENTS 4,410,370 10/1983 Baba et al. ..... 148/11.5 A

*Primary Examiner*—R. Dean

*Attorney, Agent, or Firm*—Flynn, Thiel, Boutell & Tanis

[57] ABSTRACT

An aluminum alloy material having a high strength, small grain size, good resistance to stress corrosion cracking and very high degree of workability is produced from an aluminum base alloy consisting essentially of 5.1 to 8.1 wt. % Zn, 1.8 to 3.4 wt. % Mg, 1.2 to 2.6 wt. % Cu, up to 0.2 wt. % Ti and at least one of 0.18 to 0.35 wt. % Cr and 0.05 to 0.25 wt. % Zr, the balance being aluminum and impurities by an improved production method described in detail in the disclosure. The improved method is particularly characterized by a special annealing step in a continuous annealing furnace under the application of a tension not exceeding 2 kg/mm$^2$ to a coiled alloy sheet to be annealed, the annealing including rapid heating of the coiled alloy sheet to a temperature of 400° to 500° C. at a heating rate exceeding 50° C./min.

10 Claims, 5 Drawing Figures

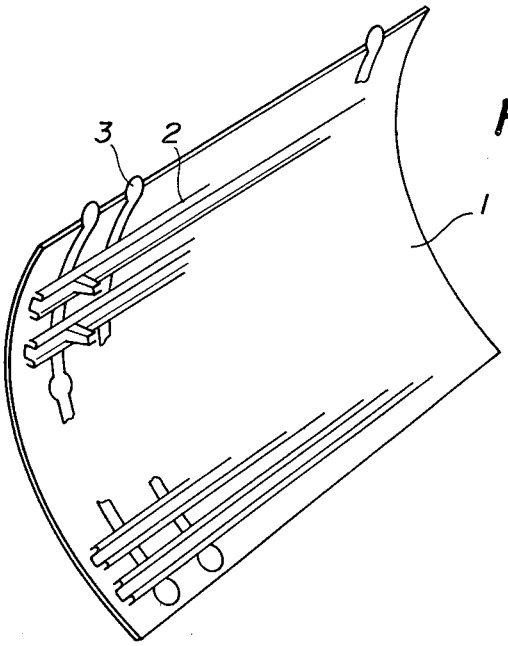
Fig. 1
Fig. 2
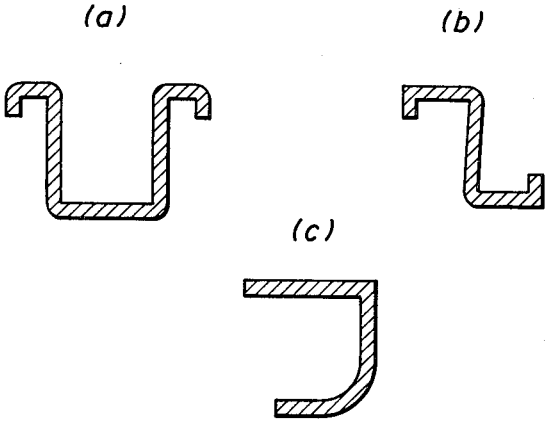

METHOD FOR PRODUCING FINE-GRAINED, HIGH STRENGTH ALUMINUM ALLOY MATERIAL

BACKGROUND OF THE INVENTION

This invention relates to a method for producing a fine-grained, high strength aluminum alloy material whose grain size does not unfavorably grow after the material has been subjected to a light cold working and a subsequent solution treatment.

More particularly, this present invention relates to a method for producing high strength aluminum alloy materials having a fine grain size and suitable for use in the manufacture of reinforcements for aircraft, such as stringers, stringer frames and the like.

As illustrated in FIG. 1, aircraft stringer 2 and stringer frame 3 are reinforcements which are used in the longitudinal direction and in the circumferential direction, respectively, of the inside of the aircraft fuselage 1. FIGS. 2(*a*), 2(*b*) and 2(*c*) are sectional views of the stringer 2 which, respectively show a cup-shaped stringer, (a) a Z-shaped sgringer and a (b) somewhat J-shaped stringer (c).

Conventionally, AA7075 alloy is well known as a typical material making for an aircraft stringer and stringer frame and has had wide-spread use in the aircraft field. Generally, the alloy is fabricated into the aircraft stringer or stringer frame by the following process.

The AA7075 alloy ingot is homogenized by heating at about 460° C. to 480° C. for 16 to 24 hours and hot rolled at 400° C. to provide a sheet coil approximately 6 mm thick. This sheet coil is then intermediately annealed at around 420° C. for 2 hours, furnace cooled and rolled to a plate of 2 to 4 mm in thickness. The cold rolled sheet coil is annealed by heating to a temperature of 420° C. for 8 to 12 hours and holding the temperature for about two hours. Further, the annealed sheet coil is cooled at a cooling rate of 25° C./hr to produce an O-material of the AA7075 alloy.

Further, the O-material is subjected to a stepped cold working at various cold reductions ranging from 0 to 90%, and subsequently to a solution heat treatment, thereby providing a material suitable for use in manufacturing stringers and stringer frames.

In the step of the stepped cold working, the O-material is worked to various amounts of cold reduction along the longitudinal direction, for example, as shown in FIG. 3. In FIG. 3, A shows a portion which has not been cold worked, and B, C and D show portions which have been cold worked to a relatively light reduction, a intermediate reduction and a relatively heavy reduction respectively. Such stepped cold working is practiced in order to vary the thickness according to the strength required in each portion and, as a result, to reduce the total weight of the aircraft fuselage structure.

The material which has received the stepped cold working is solution-treated and formed into the desired shape such as, for example, cup-shape shown in FIG. 2(*a*), by section roll-forming and the treated material is subjected to a T6 tempering treatment to provide the aircraft stringer and stringer frame.

However, the conventional stringer materials have, for example, the following disadvantages:

The O-materials used as the stringer and stringer frame materials produced from AA7075 alloy according to the above conventional method have a large grain size of 150–250 μm, and if the O-materials are subjected to cold working (taper rolling) with a relatively light cold rolling reduction of approximately 10–30%, and then to the solution heat treatment, the grain size further increases. Particularly, cold reduction of 20% is known to cause the most marked grain growth. Of course, when the above conventional O-materials have received a relatively heavy cold reduction of more than 50% and then the solution heat treatment, it is possible to make the fine grain size approximately 50 μm in the material. However, in practice, cold rolling reduction of a wide range of 0 to 90% is conducted on one O-material of about 10 m in length so that it is extremely difficult to achieve a grain size not exceeding 100 μm over the entire length.

FIG. 4 illustrates a relationship between the reduction amount (%) by cold working and the grain size (μm) of the conventional material which has been cold worked to various reductions and then solution heat treated. As can be seen in FIG. 4, in portions D, F and G which have been cold worked to a large amount of cold reduction, the grain size is small, while, in portions A, B, C and E with small cold reduction, the grain size is very large. The coarse grained portions, such as A, B, C and E, having a grain size more than 100 μm, cause decrease of mechanical properties, such as elongation, fracture toughness and the like, chemical milling property, fatigue strength, etc., and further undesirable orange peel appearance and occurrence of cracks during the section roll-forming. Hence, the production of the stringers and stringer frames is not only very difficult, but also the properties of the products are not satisfactory.

SUMMARY OF THE INVENTION

The primary object of the present invention is to provide a method for producing a fine-grained, high strength aluminum alloy material whose grain size does not exceed 100 μm after the material has been subjected to cold working of up to 90% reduction and a subsequent solution heat treatment, wherein the above-mentioned disadvantages encountered in the conventional practice are eliminated.

The high strength aluminum alloy materials contemplated by the present invention consist essentially of 5.1 to 8.1 wt.% Zn, 1.8 to 3.4 wt.% Mg, 1.2 to 2.6 wt.% Cu, up to 0.2 wt.% Ti and at least one of 0.18 to 0.35 wt.% Cr and 0.05 to 0.25 wt.% Zr, the balance being aluminum and impurities, the grain size of the material not exceeding 100 μm after the material has been subjected to cold working up to a maximum cold rolling reduction of 90% and subsequent solution heat treatment.

In order to produce the high strength, fine-grained aluminum alloy material according to the present invention, an aluminum base alloy consisting essentially of 5.1 to 8.1 wt.% Zn, 1.8 to 3.4 wt.% Mg, 1.2 to 2.6 wt.% Cu, up to 0.2 wt.% Ti and at least one of 0.18 to 0.35 wt.% Cr and 0.05 to 0.25 wt.% Zr, the balance being aluminum and impurities is homogenized, hot rolled while coiling the hot rolled sheet, and the coiled sheet is cold rolled to a given thickness. The cold rolled alloy material in the coiled form is then annealed under the application of a tension not exceeding 2 kg/mm$^2$ in a continuous annealing furnace by rapid heating to a temperature of 400° to 500° C. (but, if heating time is short, a heating temperature up to 530° C. is also practicable) at an average heating rate of more than 50° C./min. and maintaining same at that temperature for a period of 10 seconds to 10 minutes. In this annealing step, if the succeeding cooling is performed at a cooling rate of 30° C./hour and upward, the material may be further reheated to 260° to 350° C. and cooled, or the material may be cooled at a cooling rate of 30° C./hour or less.

The thus annealed material is subjected to stepped cold working to various cold reductions ranging from 0 to 90% and solution heat treatment.

BRIEF DESCRIPTION OF THE DRAWINGS

FIG. 1 is a partial perspective view of the inside of an aircraft fuselage.

FIG. 2(*a*), FIG. 2(*b*) and FIG. (*c*) are sectional views which exemplify the shapes of aircraft stringers.

DETAILED DESCRIPTION OF THE PREFERRED EMBODIMENTS

Figure 3:
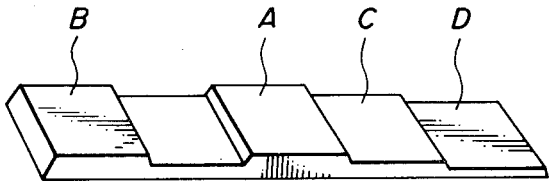
FIG. 3 is a perspective view showing the state of cold working of stringer material.
Figure 4:
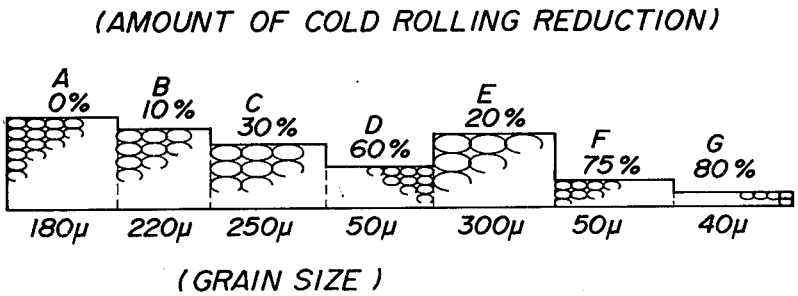
FIG. 4 is an enlarged schematic view illustrating the relationship between cold reduction by cold working and grain size after solution treatment for conventional stringer material.

According to the present invention, there is disclosed a method for producing a fine-grained, high strength aluminum alloy material which maintains a fine grain size not exceeding 100 μm after having been subjected to cold working to a reduction up to 90%, and thereafter, to solution heat treatment, the material consisting essentially of 5.1 to 8.1 wt.% Zn, 1.8 to 3.4 wt.% Mg, 1.2 to 2.6 wt.% Cu, up to 0.2 wt.% Ti, and at least one of 0.18 to 0.35 wt.% Cr and 0.05 to 0.25 wt.% Zr, the balance being aluminum and impurities.

In practicing the present invention, the composition limit of the aluminum alloy material described above must be closely followed in order to achieve the objects contemplated by the invention. The reason for the limitation of each component of the material according to the present invention is as follows:

Zn: When its content is less than 5.1 wt.%, the strength of the material (hereinafter referred to as "T6-material") after the T6 type heat treatment does not reach the required level. On the other hand, when the content exceeds 8.1 wt.%, fracture toughness of the T6-material decreases and stress corrosion cracking is apt to occur.

Mg: If the content is less than 1.8 wt.%, the strength of the T6-material after the T6 type heat treatment is low, and, if the content exceeds 3.4 wt.%, the cold-workability of annealed material does not reach the required level. Further the fracture toughness of the T6-material decreases.

Cu: A content of less than 1.2 wt.% lowers the strength of the T6-material and a content of more than 2.6 wt.% lowers the fracture toughness of the material.

Ti: The addition of 0.2 wt.% or less of Ti is effective to prevent the cracking of the ingot during grain refinement of cast structures. However the addition of more than 0.2 wt.% leads to formation of giant intermetallic compounds.

Cr: A content of less than 0.18 wt.% causes the stress corrosion cracking. On the other hand, a content of more than 0.35 wt.% leads to formation of giant intermetallic compounds.

Zr: The addition between 0.05 and 0.25 wt.% serves effectively to prevent stress corrosion cracking and to refine the grain size. If the content is less than 0.05 wt.%, the above effect is insufficient and if it exceeds 0.25 wt.%, giant intermetallic compounds are formed. Formation of giant intermetallic compounds should be avoided.

As impurities, Fe, Si and Mn must be restricted as follows:

Fe: This component has an effect on the grain refinement, but if its content exceeds 0.50 wt.%, the amount of insoluble compounds increases in the alloy, lowering the fracture toughness of the material.

Si: This component exhibits an effect on grain refinement. A content of more than 0.40 wt.% increases the amount of insoluble compounds in the alloy, leading to lowering of the fracture toughness of the material.

Mn: This imparts high resistance to stress corrosion cracks to the material. If its content exceeds 0.70 wt.%, sufficient quench sensitivity and fracture toughness cannot be attained.

The high strength aluminum alloy material produced by a process of the present invention described in detail hereinafter has a fine grained structure over the entire length. Thus, when the material is used in the manufacture of the aircraft stringers, stringer frames, or the like, not only cracks and formation of an orange peel-like surface during the section roll-forming can be avoided, but also there is provided stringers and string frames having highly improved mechanical properties, elongation, fracture toughness, chemical milling property, fatigue strength, etc.

The method of the present invention is characterized by the steps comprising;

homogenizing an aluminum base alloy consisting essentially of 5.1 to 8.1 wt.% Zn, 1.8 to 3.4 wt.% Mg, 1.2 to 2.6 wt.% Cu, up to 0.2 wt.% Ti and at least one of 0.18 to 0.35 wt.% Cr and 0.05 to 0.25 wt.% Zr, the balance being aluminum and impurities;

hot rolling said alloy while coiling the hot rolled sheet;

cold rolling said coiled sheet to a given thickness;

annealing said coiled sheet in a continuous annealing furnace by rapid heating to a temperature of 400° to 500° C. at an average heating rate exceeding 50° C./min., holding at the temperature for a period of 10 seconds to 10 minutes, said coiled material being strained by applying a tension not exceeding 2 kg/mm$^2$ thereto in said annealing step;

cold working said material to a rolling reduction of 0 to 90%; and solution heat treating said sheet.

In the annealing step above described, when the high temperature exposure is followed by cooling at a cooling rate of 30° C./hr or more, the material may be reheated to a temperature of 260° to 350° C. and air-cooled or cooled at a cooling rate of 30° C./hr or less to produce a material having a high workability.

In a preferred embodiment of the present invention, an ingot of the alloy specified above is homogenized at a temperature of 400° to 490° C. for 2 to 48 hours so that Zn, Mg and Cu may fully dissolve, and, at the same time, Cr and Zr may precipitate as a fine intermetallic compound. If homogenization is insufficient, due to an inadequate heating temperature or insufficient heating time, hot workability of the aluminum base alloy ingot and resistance to stress corrosion cracking will decrease and, further, grain growth will occur. On the other hand, when the heating temperature for the homogenizing treatment exceeds 490° C., undesirable eutectic melting occurs.

Hot rolling after the homogenizing treatment is preferably initiated from a starting temperature of 350° to 470° C. When the starting temperature is less than 350° C., deformation resistance of the material is increased and a sufficient hot rolling workability cannot be achieved. A starting temperature of more than 470° C. reduces the workability of the alloy and causes occurence of cracks during hot rolling. Thus, it is preferable to set the initial temperature within the above range.

Following the above hot rolling, an annealing treatment may, if desired, be performed. This treatment is performed by holding the hot rolled sheet at a temperature of 300° to 460° C. and then cooling it to a temperature of approximately 260° C. at a cooling rate not exceeding 30° C./hr. This annealing step is particularly needed when the rolling reduction in the subsequent cold rolling is high.

The cold rolling reduction in the cold rolling operation is preferably 20% or more, since, when the rolling reduction is low, the grain size of the resultant stringer material grows to 100 μm or more.

Cold rolled sheet in the coiled form is thereafter further subjected to annealing characterized by rapid heating to a temperature of 400° C. to 500° C. at a heating rate of more than 50° C./min. under the application of a tension not exceeding 2 kg/mm$^2$ in a continuous annealing furnace. This process is especially significant in producing high quality stringer and stringer frame materials.

Conventional annealing of the AA7075 alloy has been accomplished by heating to a temperature of 413° to 454° C., holding at this temperature for two hours, air cooling, reheating to a temperature of 232° C., holding at the temperature for six hours and finally cooling to room temperature. This annealing procedure is proposed in MIL Spec. H6088E. item 5.2.7.2 by the Department of Defense of the USA and has been well known as the most normal annealing method for the 7075 alloy in the aircraft field. Thus, the above annealing process according to the present invention will be found to exceed the above common knowledge.

When the heating temperature exceeds 500° C., the material melts and unfavorable marked grain growth occurs, forming very coarse recrystallized-grains in the material. But when the heating time is short, a heating temperature up to 530° C. is operable.

On the other hand, when the heating temperature is below 400° C., annealing and recrystallization of the material are not achieved sufficiently. In producing the aircraft stringer or stringer frame, since such phenomenon causes cracks on the stepped cold working (taper rolling work), such phenomenon should be avoided. It was found that only the above range of heating temperatures, 400° to 500° C., enables the production of a stringer and stringer frame materials having fine grain sizes not exceeding 100 μm.

With regard to a heating rate to achieve the above high temperature, the rapid heating at an average heating rate of more than 50° C./min. is essential, because the rapid heating reduces precipitation of Mg-Zn type compounds during heating and dislocation structure induced by the cold rolling will be changed to a uniformly fine cell structure by the above annealing treatment including the rapid heating step. When the thus obtained material is subjected to the taper rolling work with a comparatively small rolling reduction (10 to 30%) and then to the solution heat treatment, such fine cell structure serves as nuclei for recrystallization and develops a uniformly fine recrystallized grain structure. On the other hand, if, in the annealing process, the average heating rate is 50° C./min. or less, Mg-Zn type compounds precipitate nonuniformly during heating to a given annealing temperature. And, at the same time, the dislocation structure formed during the preceding cold rolling step will disappear completely or remain a coarse, nonuniform cell structure. If the thus annealed material receives the taper rolling work with the above comparatively small reduction and then the solution heat treatment, the recrystallized grain becomes coarse so that a uniform and fine recrystallized grain structure cannot be obtained.

A holding time at the above temperature of 400° to 500° C. is preferably from 10 seconds to 10 minutes, and more preferably 3 minutes at a temperature of 470° C. When the heating time is less than 10 seconds, recrystallization cannot be completely achieved. On the other hand, when the heating time is more than 10 minutes, an efficiency of annealing in a continuous furnace is low.

In the annealing step or stage, the coiled sheet is strained by applying a tension not exceeding 2 kg/mm$^2$ thereto, since the annealing operation cannot be successfully conducted on the cold rolled sheet in the coiled form. When the tension is more than 2kg/mm$^2$, fracture of coils occurs in the annealing process. The application of the tension not exceeding 2 kg/mm$^2$ flattens the sheet and aids refinement of grain size. Further, alloying elements of Zn, Mg and Cu dissolve readily owing to the tension.

Referring to the cooling rate after the above heating, a cooling rate less than 30° C./hour can achieve a complete O-material and impart a high degree of cold workability. Thus such cooling makes possible a taper rolling reduction of wide range of up to 90% at a time.

On the other hand, when the cooling rate is relatively rapid as in the case of air-cooling or forced air-cooling, the material is hardened, that is, age-hardened, and, thus, an O-material having a higher strength relative to that of usual O-material is obtained. Thus, such rapid cooling does not matter when the O-materials are to be used in stringer materials which are cold worked to a comparatively small amount of cold reduction. However, the rapid cooling is undesirable for O-materials which are to be subjected to a large amount of cold reduction. For this, further study was conducted and an additional following low-temperature annealing was found to overcome the above problem.

In practicing the annealing, when the high temperature exposure at 400° to 500° C. is followed by a rapid cooling at the cooling rate of 30° C./hr or more, the annealing process is performed by a two-stage thermal treatment under tension not exceeding 2 kg/mm$^2$ in a continuous annealing furnace. The first stage of thermal treatment is performed by rapidly heating the coiled cold rolled material to 400° to 500° C. at an average heating rate exceeding 50° C./min., as described above, and holding at the temperature for 10 seconds to 10 minutes, and cooling at a rate of 30° C./hour or more. Following the first stage of thermal treatment, the material is subjected to the second stage of thermal treatment.

The second stage of thermal treatment is performed by reheating to a temperature within the range of 260° to 350° C. and subsequently air-cooling or cooling at a cooling rate of 30° C./hr or less. By adding the above reheating step to the first rapid heating step, fully annealed materials can be produced and a high degree of rolling reduction can be easily achieved, even if the cooling rate after the first rapid heating is 30° C./hr or more.

Figure 5:
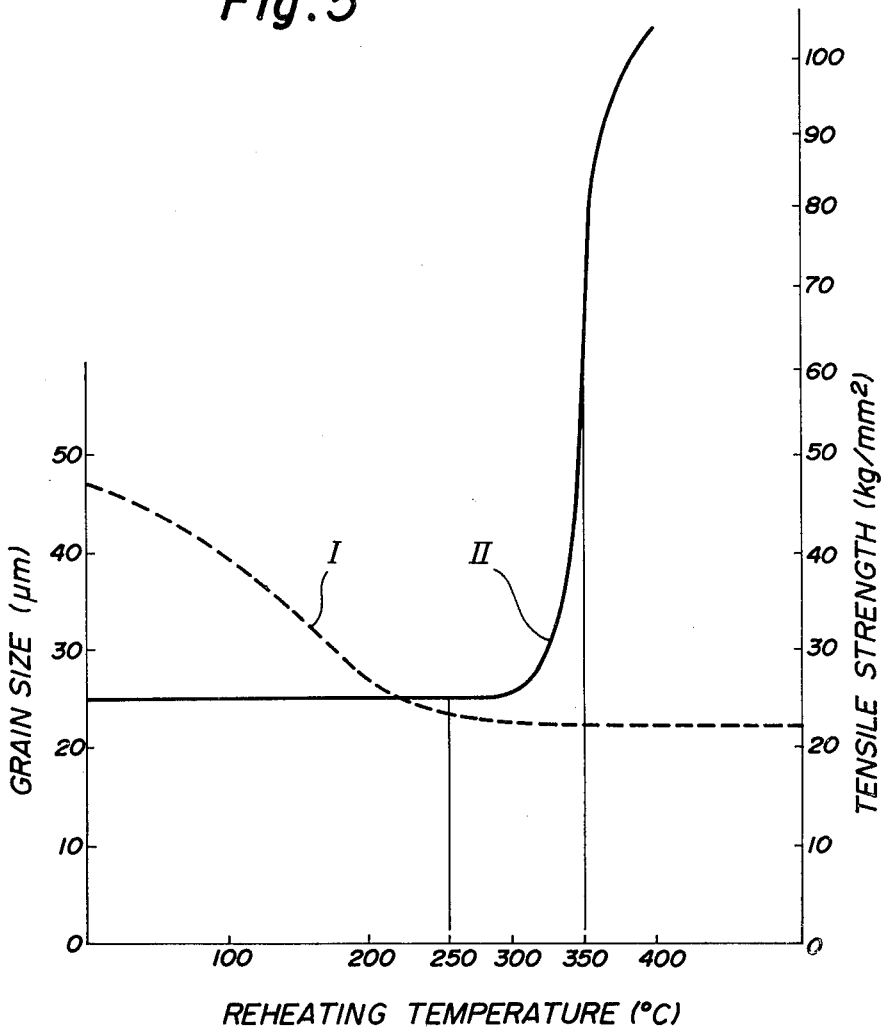
FIG. 5 is a graph showing the relationship between tensile strength of O-material or grain size of W-material and reheating temperature.

The experiments proved that when the above annealing process is performed by the two-stage thermal treatment, the reheating temperature at the second stage has a significant effect on the tensile strength of the O-material and grain size of W-material after having been subjected to stepped cold working and solution heat treatment. This effect, for example, is demonstrated in FIG. 5 which plots the tensile strengths (Curve I) of O-materials annealed by rapid heating and subsequently reheated to various temperatures, and grain size (Curve II) of W-materials obtained ater cold working to 16% cold reduction the respective O-materials reheated to various reheating temperatures, solution heat treating at 494° C. for 40 minutes and then water quenching, against reheating temperature in the annealing process. In this measurement, the first stage of thermal treatment in the annealing process was accomplished by rapid heating, air cooling and leaving at room temperature. Thus, this treatment gives a hardening effect to the material, increasing the tensile strength of the material thus treated. As can be seen from FIG. 5, the tensile strength was decreased with an increase in reheating temperature. The grain size of W-material which received the above cold working to 16% reduction, solution heat treatment and water quenching was dependent on the reheating temperature. A reheating temperature of 260° to 350° C. gave comparatively small grain size of 25–40 μm, and a reheating temperature exceeding 350° C. gave a considerably coarse grain size.

In order to further understand the present invention and the advantages derived therefrom, the following examples are presented.

TABLE 1

| Alloy No. | Chemical Composition (wt. %) | | | | | | | | | |
|---|---|---|---|---|---|---|---|---|---|---|
| | Si | Fe | Cu | Mn | Mg | Cr | Zn | Ti | Zr | Al |
| 1 | 0.14 | 0.20 | 1.6 | 0.03 | 2.5 | 0.22 | 5.7 | 0.02 | — | Balance |
| 2 | 0.09 | 0.18 | 1.7 | 0.01 | 2.4 | 0.24 | 5.8 | 0.03 | — | Balance |
| 3 | 0.14 | 0.25 | 1.7 | 0.03 | 2.3 | 0.20 | 5.8 | 0.03 | — | Balance |
| 4 | 0.10 | 0.18 | 1.8 | 0.02 | 2.1 | 0.25 | 7.0 | 0.05 | 0.10 | Balance |
| 5 | 0.16 | 0.24 | 2.1 | 0.01 | 2.9 | 0.20 | 6.8 | 0.04 | 0.10 | Balance |
| 6 | 0.11 | 0.19 | 1.8 | 0.01 | 2.4 | 0.21 | 5.9 | 0.04 | — | Balance |
| 7 | 0.15 | 0.23 | 2.2 | 0.01 | 2.7 | 0.01 | 6.7 | 0.05 | 0.14 | Balance |
| 8 | 0.11 | 0.22 | 1.0 | 0.02 | 1.6 | 0.19 | 4.5 | 0.03 | — | Balance |

TABLE 1-continued

| Alloy No. | Chemical Composition (wt. %) | | | | | | | | | |
|---|---|---|---|---|---|---|---|---|---|---|
| | Si | Fe | Cu | Mn | Mg | Cr | Zn | Ti | Zr | Al |
| 9 | 0.13 | 0.20 | 2.8 | 0.03 | 3.6 | 0.23 | 8.4 | 0.04 | — | Balance |

Note:
Nos. 1–7 Alloys according to the present invention
Nos. 8–9 Alloys for comparison

EXAMPLE 1

Materials 3 mm thick according to the present invention and comparative materials 3 mm thick according to the conventional method were respectively prepared using ingots of alloy Nos. 1 and 4 shown in Table 1 by the following methods.

Method according to the present invention:

Homogenization treatment (at 460° C. for 24 hours)→Hot rolling (from 300 mm to 6 mm in thickness at 400° C.) while coiling→Cold rolling (from 6 mm to 3 mm in thickness)→Annealing under the application of a tension of 0.3 kg/mm$^2$ in a continuous annealing furnace (rapid heating to a temperature of 470° C. at a heating rate of 100° C./min.→holding for 3 minutes at the temperature→compulsory air-cooling at a cooling rate of 100° C./min.→reheating at 300° C. for 1 hour→furnace cooling to 200° C. at a cooling rate of 20° C./hr)→Cold working (cold reduction of 0–90%, as shown in Table 2)→Solution heat treatment (at 480° C. for 40 minutes, in a salt bath)→Water quenching→Materials according to the present invention. Method according to the conventional method:

Homogenization treatment (heating at 460° C. for 24 hours)→Hot rolling (from 300 mm to 6 mm in thickness at 400° C.)→heating at 420° C. for 2 hours and cooling at a rate of 30° C./hr→Cold rolling (from 6 mm to 3 mm in thickness)→Annealing (heating to 420° C. at a rate of 25° C./hr and holding at 420° C. for 2 hours→cooling at a rate of 25° C./hr→holding at 235° C. for 6 hours →air cooling)→Cold working (cold reduction of 0–90%, as shown in Table 2)→Solution heat treatment (at 480° C. for 40 minutes, in a salt bath)→Water quenching→Materials according to the conventional method.

Properties of materials (W-materials) prepared in the above were tested and are given in Table 2, together with grain sizes and reduction amounts of cold working conducted before the solution heat treatment.

In comparing the present invention and the conventional method, it becomes clear from Table 2 that the present invention can provide a W-material having a fine grain size not exceeding 100 μm over a wide range of cold reduction, that is, 0–90%. Thus, the bending property of W-material, elongation of T6-material and fracture toughness are highly improved.

TABLE 2

| Alloy No. | Production Method | Cold Reduction (%) | Grain Size of W-Material (μm) | Result of Bending Test of W-Material* | | Mechanical Properties of T6-Material | | | Fracture Toughness (MN · m$^{-3/2}$) |
|---|---|---|---|---|---|---|---|---|---|
| | | | | External Appearance | Occurrence of Crack | Yield Strength (kg/mm$^2$) | Tensile Strength (kg/mm$^2$) | Elongation (%) | |
| 1 | Method of Present Invention | 0 | 32 | Good | None | 51.3 | 57.1 | 16 | 120 |
| | | 9 | 35 | " | " | 52.1 | 57.7 | 14 | 120 |
| | | 20 | 40 | " | " | 52.7 | 57.4 | 14 | 122 |
| | | 30 | 35 | " | " | 51.6 | 57.4 | 14 | 122 |
| | | 60 | 35 | " | " | 50.7 | 57.2 | 16 | 122 |
| | | 90 | 27 | " | " | 51.0 | 57.1 | 16 | 123 |
| 1 | Conventional Method | 0 | 210 | Orange peel | Crack | 50.1 | 56.4 | 10 | 38 |

TABLE 2-continued

| Alloy No. | Production Method | Cold Reduction (%) | Grain Size of W-Material (μm) | Result of Bending Test of W-Material* External Appearance | Occurrence of Crack | Mechanical Properties of T6-Material Yield Strength (kg/mm²) | Tensile Strength (kg/mm²) | Elongation (%) | Fracture Toughness (MN · m$^{-3/2}$) |
|---|---|---|---|---|---|---|---|---|---|
| | | 9 | 240 | Orange peel | " | 51.2 | 57.0 | 9 | 80 |
| | | 20 | 300 | Orange peel | " | 51.3 | 56.8 | 8 | 80 |
| | | 30 | 200 | Orange peel | " | 50.6 | 56.3 | 11 | 87 |
| | | 60 | 50 | Good | None | 49.9 | 56.6 | 14 | 114 |
| 4 | Method of Present Invention | 0 | 27 | " | " | 53.3 | 60.1 | 17 | 115 |
| | | 9 | 32 | " | " | 54.1 | 60.7 | 15 | 115 |
| | | 20 | 35 | " | " | 54.7 | 60.4 | 14 | 117 |
| | | 30 | 35 | " | " | 53.5 | 60.4 | 15 | 117 |
| | | 60 | 30 | " | " | 52.7 | 60.1 | 16 | 117 |
| | | 90 | 25 | " | " | 52.9 | 60.6 | 16 | 122 |
| 4 | Conventional Method | 0 | 200 | Orange peel | Crack | 52.4 | 59.4 | 10 | 84 |
| | | 9 | 230 | Orange peel | " | 53.0 | 60.1 | 10 | 79 |
| | | 20 | 280 | Orange peel | " | 53.3 | 59.8 | 9 | 79 |
| | | 30 | 200 | Orange peel | " | 52.8 | 59.8 | 10 | 82 |
| | | 60 | 50 | Good | None | 52.1 | 59.6 | 14 | 110 |

Note:
*Bending of 90°, Bending Radius = 1.5t (t = Thickness of Sheet) The test was carried out after 4 hours from the water quenching.

EFFECT OF HEATING RATE IN THE RAPID HEATING STEP

EXAMPLE 2

Ingots 350 mm thick of alloy No.1 were homogenized at 470° C. for 16 hours, hot rolled between a starting temperature of 430°C. and a final temperature of 340° C. to provide coiled sheets 6 mm thick. Subsequently, the hot rolled coiled sheets were cold rolled to provide coiled sheets 3 mm thick, and received the following annealing treatment under the application of a tension of 0.2 kg/mm² in a continuous annealing furnace to provide O-materials 3 mm thick. Annealing was accomplished by heating to a temperature of 470° C. at the various heating rates shown in Table 3, holding at the temperature for three minutes, air cooling, heating at 300° C. for one hour and cooling at a cooling rate of 25° C./hr.

The O-materials obtained in the above were further cold worked to various cold reductions shown in Table 3, solution heat treated at 480° C. for 40 minutes in the salt bath and water quenched to provide W-materials.

The relation between grain size of W-materials and the heating rate is given in Table 3.

TABLE 3

| Average Heating Rate to 470° C. (°C./min) | Cold Reduction (%) 0 | 10 | 20 | 30 | 60 |
|---|---|---|---|---|---|
| | Grain Size of W-Material (μm) | | | | |
| 200 | 30 | 30 | 35 | 30 | 25 |

TABLE 3-continued

| Average Heating Rate to 470° C. (°C./min) | Cold Reduction (%) 0 | 10 | 20 | 30 | 60 |
|---|---|---|---|---|---|
| | Grain Size of W-Material (μm) | | | | |
| 150 | 30 | 30 | 35 | 30 | 28 |
| 100 | 30 | 30 | 35 | 35 | 30 |
| 70 | 30 | 35 | 40 | 40 | 30 |
| 60 | 30 | 35 | 40 | 40 | 30 |
| 30 | 110 | 120 | 170 | 150 | 45 |
| 10 | 120 | 140 | 200 | 170 | 50 |
| 2.4 | 200 | 230 | 280 | 200 | 50 |
| 0.9* | 200 | 240 | 300 | 210 | 50 |

Note:
*Heating rate according to the conventional practice.

As can be seen in Table 3, when an average heating rate to 470° C. exceeds 50° C./min., the material after cold working and solution treatment had a uniform fine grain size not exceeding 100 μm.

On the other hand, when the heating rate is less than 50° C./min, marked grain growth occurs.

The W-materials which were heated to 470° C. at heating rates of 100° C./min, 60° C./min, 30° C./min and 0.9° C./min in the annealing step were further tested.

Following water quenching, the respective W-materials were aged at 120° C. for 24 hours to provide T6-materials. Properties of the W-materials and the T6-materials are given in Table 4. It will be clear in this Table that an average heating rate exceeding 50° C./min gave the materials suitable for use as aircraft stringer and stringer frame.

TABLE 4

| Average Heating Rate (°C./min) | Cold Reduction (%). (μm) | Grain Size after Solution Heat Treatment Appearance | Results of Bending Test of W-Material* External of Crack | Occurrence (kg/mm²) | Mechanical Properties of T6-Material Yield Strength (kg/mm²) | Tensile Strength (%) | Elongation |
|---|---|---|---|---|---|---|---|
| 100 | 0 | 30 | Good | None | 51.1 | 57.2 | 16 |
| | 10 | 30 | " | " | 52.1 | 57.7 | 13 |
| | 20 | 35 | " | " | 52.5 | 57.9 | 13 |
| | 33 | 35 | " | " | 50.9 | 56.9 | 16 |

TABLE 4-continued

| Average Heating Rate (°C./min) | Cold Reduction (%). (μm) | Grain Size after Solution Heat Treatment Appearance | Results of Bending Test of W-Material* External of Crack | Occurrence (kg/mm²) | Mechanical Properties of T6-Material Yield Strength (kg/mm²) | Tensile Strength (%) | Elongation |
|---|---|---|---|---|---|---|---|
| | 50 | 30 | " | " | 50.5 | 57.4 | 16 |
| | 80 | 25 | " | " | 50.3 | 57.8 | 16 |
| 60 | 0 | 30 | " | " | 51.1 | 57.1 | 15 |
| | 10 | 35 | " | " | 52.7 | 57.4 | 12 |
| | 20 | 40 | " | " | 53.1 | 57.1 | 13 |
| | 33 | 40 | " | " | 50.9 | 56.9 | 15 |
| | 50 | 30 | " | " | 49.9 | 57.7 | 17 |
| | 80 | 30 | " | " | 50.5 | 57.4 | 16 |
| 30 | 0 | 100 | Orange Peel | Slight Crack | 50.4 | 56.4 | 14 |
| | 10 | 120 | " | " | 51.7 | 56.5 | 13 |
| | 20 | 170 | " | " | 51.6 | 57.2 | 13 |
| | 33 | 150 | " | " | 50.8 | 56.8 | 13 |
| | 50 | 40 | Good | None | 50.4 | 56.6 | 15 |
| | 80 | 40 | " | " | 50.1 | 56.1 | 15 |
| 0.9 | 0 | 200 | Orange Peel | Crack | 50.1 | 56.6 | 10 |
| | 10 | 240 | " | " | 51.2 | 57.1 | 9 |
| | 20 | 300 | " | " | 51.3 | 56.9 | 9 |
| | 33 | 210 | " | " | 50.9 | 57.0 | 10 |
| | 50 | 50 | Good | None | 50.2 | 56.9 | 10 |
| | 80 | 40 | " | " | 49.9 | 56.1 | 10 |

Note:
*90° Bending, Bending Radius = 1.5t (t = Thickness of Sheet) The test was carried out after 4 hours from water quenching.

EFFECT OF HEATING TEMPERATURE

EXAMPLE 3

Cold rolled sheets 3 mm thick were prepared using ingots of alloy No.2 in the same procedure as in the case of Example 2. Following cold rolling, the sheets were subjected to the following two-stage annealing treatment in a continuous annealing furnace while applying a tension of 0.25 kg/mm² thereto. In the first stage, the sheets were heated to various heating temperatures of 415° to 520° C. at various heating rates, shown in Table 5, held at the temperatures for times shown in the same Table and air cooled. After the first heating treatment, the sheets were reheated at 300° C. for one hour and cooled at a rate of 20° C./hr, providing O-materials 3 mm thick.

The O-materials obtained in the above were cold worked to various cold reductions, solution heat treated at 494° C. for 40 minutes in the salt bath and water quenched, providing W-materials.

The relation between the grain sizes of W-materials and the first stage heating temperature is given in Table 5. It can be seen from the Table 5 that only the O-material which has received annealing treatment characterized by rapid heating to 400° to 500° C. can be converted to a desirable fine grained W-material even after cold working with a light cold reduction and subsequent solution heat treatment. When the heating temperature was beyond the above range, W-material of fine grain size could not be obtained ater cold working with a small amount of cold reduction and solution heat treatment.

Three O-materials 3 mm thick selected from the above O-materials were further examined. The three O-material were cold worked up to a maximum reduction of 80%, solution heat treated at 494° C. for 40 minutes in the salt bath and water quenched to provide W-materials. The W-materials were further aged at 122° C. for 24 hours to produce T6-materials. Properties of the above W-materials and T6-materials are shown in Table 6. From this table it is apparent that all materials have sufficient properties to be useful as stringer material.

TABLE 5

| Average Heating Rate (°C./min) | Heating Temperature (°C.) | Holding Time | Cold Reduction (%) 0 | 10 | 20 | 30 | 60 | 80 |
|---|---|---|---|---|---|---|---|---|
| | | | Grain Size of W-Material (μm) | | | | | |
| 100 | 480 | 30 sec | 30 | 35 | 40 | 40 | 30 | 25 |
| 210 | 460 | 3 min | 30 | 35 | 40 | 40 | 30 | 25 |
| 150 | 430 | 5 min | 30 | 40 | 40 | 40 | 30 | 30 |
| 80 | 415 | 9 min | 35 | 45 | 45 | 45 | 35 | 30 |
| 70 | 495 | 20 sec | 40 | 40 | 45 | 45 | 35 | 30 |
| 100 | 470 | 3 min | 30 | 35 | 40 | 40 | 35 | 30 |
| 150 | 410 | 8 min | 40 | 50 | 60 | 60 | 35 | 35 |
| 100 | 520* | 3 min | 100 | 120 | 150 | 130 | 50 | 40 |

Note:
*Eutectic melting occurred.

TABLE 6

| Average Heating Rate (°C./min) | Heating Temperature (°C.) | Cold Reduction (%) | Grain Size of W-Material (μm) | Results of Bending Test of W-Material* External Appearance | Occurrence of Crack | Mechanical Properties of T6-Material Yield Strength (kg/mm²) | Tensile Strength (kg/mm²) | Elongation (%) |
|---|---|---|---|---|---|---|---|---|
| 100 | 480 | 0 | 30 | Good | None | 51.4 | 57.2 | 15 |
| | | 10 | 35 | " | " | 52.4 | 58.0 | 14 |
| | | 20 | 40 | " | " | 52.9 | 57.1 | 14 |
| | | 30 | 40 | " | " | 51.8 | 57.5 | 16 |
| | | 60 | 30 | " | " | 50.5 | 57.2 | 17 |
| | | 80 | 24 | " | " | 50.8 | 57.3 | 16 |
| 150 | 430 | 0 | 30 | " | " | 51.4 | 57.1 | 15 |
| | | 11 | 40 | " | " | 53.2 | 57.5 | 13 |

TABLE 6-continued

| Average Heating Rate (°C./min) | Heating Temperature (°C.) | Cold Reduction (%) | Grain Size of W-Material (μm) | Results of Bending Test of W-Material* External Appearance | Occurrence of Crack | Mechanical Properties of T6-Material Yield Strength (kg/mm²) | Tensile Strength (kg/mm²) | Elongation (%) |
|---|---|---|---|---|---|---|---|---|
| | | 20 | 40 | " | " | 53.1 | 57.5 | 15 |
| | | 28 | 40 | " | " | 51.0 | 57.2 | 16 |
| | | 53 | 30 | " | " | 50.0 | 57.1 | 15 |
| | | 75 | 25 | " | " | 50.5 | 57.4 | 15 |
| 70 | 495 | 0 | 40 | " | " | 52.2 | 57.5 | 16 |
| | | 9 | 40 | " | " | 53.3 | 58.1 | 14 |
| | | 22 | 45 | " | " | 53.0 | 57.8 | 13 |
| | | 30 | 45 | " | " | 50.8 | 57.8 | 17 |
| | | 45 | 35 | " | " | 50.1 | 57.2 | 17 |
| | | 80 | 30 | " | " | 50.9 | 57.2 | 16 |

Note:
*90° Bending, Bending Radius = 1.5t (t = Thickness of Sheet) The test was carried out after 4 hours from water quenching.

EFFECT OF HOLDING TIME AT HEATING TEMPERATURE

EXAMPLE 4

Cold rolled coiled sheets 3 mm thick were prepared from ingots of alloy No. 3 according to the practice described in Example 2. The coiled sheets were thereafter subjected to following annealing in a continuous annealing furnace, applying a tension of 0.4 kg/mm² thereto. The coiled sheets were heated to various temperatures at the various heating rates shown in Table 7, held at the heating temperatures for various times and air cooled. Following cooling the sheets were reheated at 300° C. for one hour and cooled at a cooling rate of 25° C./hr to produce O-materials 3 mm thick.

The O-materials thus produced were cold worked to 20% cold reduction which causes the most marked grain growth, solution heat treated at 485° C. for 40 minutes in the salt bath and water quenched to provide W-materials.

Table 7 shows the relation between the grain sizes of water-quenched W-materials, the heating temperature and the holding time at the heating temperature.

In the Table 7 it is shown that very fine grained materials were produced over various holding times.

Further, the O-materials were cold worked to a cold reduction of 0 to 90%, solution heat treated at 485° C. for 40 minutes in the salt bath and water quenched. The thus obtained W-materials all had fine grains not exceeding 100 μm. A bending test (bending angle 90°, bending radius =1.5 t, t=thickness of sheet) was carried out on the W-material after 4 hours from water quenching. As a result of the bending test, cracks and orange peels were not obeserved. The W-materials proved to be excellent as aircraft stringer material.

TABLE 7

| Average Heating Rate (°C./min) | Heating Temperature (°C.) | Holding Time | Grain Size of W-Material (μm) |
|---|---|---|---|
| 150 | 470 | 30 sec | 35 |
| | | 1 min | 35 |
| | | 3 " | 30 |
| | | 6 " | 35 |
| | | 9 " | 40 |
| 100 | 455 | 30 sec | 30 |
| | | 1 min | 30 |
| | | 3 " | 35 |
| | | 5 " | 40 |
| | | 8 " | 55 |
| 80 | 420 | 2 min | 35 |
| | | 4 " | 35 |

TABLE 7-continued

| Average Heating Rate (°C./min) | Heating Temperature (°C.) | Holding Time | Grain Size of W-Material (μm) |
|---|---|---|---|
| | | 6 " | 40 |
| | | 9 " | 55 |
| 180 | 480 | 20 sec | 30 |
| | | 1 min | 35 |
| | | 3 " | 35 |
| | | 7 " | 40 |

EFFECT OF ALLOY COMPOSITION

EXAMPLE 5

Ingots 400 mm thick of alloy Nos. 3 to 7 were homogenized by heating at 470° C. for 25 hours, and hot rolled to 6 mm thick between an initial temperature of 400° C. and final temperature of 300° C. Following hot rolling, the hot rolled coils were cold rolled to 3 mm thick, and annealed under the application of a tension of 1 kg/mm² in a continuous annealing furnace to provide O-materials 3 mm thick.

Annealing was accomplished by heating to 470° C. at the heating rate of 100° C./min, holding at the temperature for three minutes, air cooling, heating at 300° C. for one hour and cooling at a cooling rate of 25° C./hr.

Comparative O-materials were prepared from ingots of alloy Nos. 8 and 9 400 mm thick according to the procedure described in the case of alloy Nos. 3 to 7.

The O-materials prepared in Example 5 were cold worked to a cold reduction of 0 to 75%, solution heat treated at 470° C. for 40 minutes using the salt bath and water-quenched to produce W-materials. Grain size of the thus obtained W-materials are given in Table 8.

From Table 8 it can be seen that grain sizes of all materials are less than 100 μm over the wide range of cold reductions.

TABLE 8

| Alloy No. | Cold Reduction 0% | 10% | 20% | 30% | 60% | 75% |
|---|---|---|---|---|---|---|
| | Grain Size of W-Material (μm) | | | | | |
| 3 | 30 | 35 | 40 | 35 | 30 | 25 |
| 4 | 30 | 30 | 40 | 35 | 30 | 25 |
| 5 | 30 | 35 | 35 | 35 | 30 | 25 |
| 6 | 32 | 35 | 40 | 35 | 25 | 30 |
| 7 | 25 | 30 | 35 | 35 | 25 | 25 |
| 8 | 35 | 40 | 45 | 40 | 30 | 25 |
| 9 | 35 | 40 | 45 | 40 | 30 | 25 |

Further, O-materials prepared in the above were cold worked to a 20% cold reduction which is apt to cause the maximum grain growth, solution heat treated at 490° C. for 40 minutes in the salt bath and water quenched to provide W-materials. Properties of the W-materials are shown in Table 9 below. In addition to these properties, T6-materials which were produced by aging the W-materials with the 20% cold reduction at 121° C. for 24 hours were examined. Properties of the T6-materials also are shown in Table 9.

Upper limits of cold reduction practicable in the cold working process were measured and the results are given in Table 9.

From the table 9, it will be clear that alloy Nos. 3–7 according to the present invention gave very good properties adequate for stringers and stringer frames, but in the cases of alloy Nos. 8 and 9, such good properties could not be attained. Alloy No. 8 was inferior in strength and alloy No. 9 was apt to exhibit stress corrosion cracking. Both alloys of Nos. 8 and 9 presented problems in applications such as aircraft stringers and stringer frames.

TABLE 9

| Alloy No. | Upper Limit of Cold Reduction of O-Material (%) | Grain Size of W-Material (μM) | Result of Bending Test of W-Material* | | Stress Corrosion Cracking Life of T6-Material** | Mechanical Properties of T6-Material | | |
|---|---|---|---|---|---|---|---|---|
| | | | External Appearance | Occurrence of Crack | | Yield Strength (kg/mm²) | Tensile Strength (kg/mm²) | Elongation (%) |
| 3 | 92 | 40 | Good | None | >30 days | 52.5 | 57.3 | 15 |
| 4 | 90 | 40 | " | " | " | 55.5 | 62.6 | 13 |
| 5 | 90 | 35 | " | " | " | 56.9 | 64.0 | 13 |
| 6 | 92 | 40 | " | " | " | 53.3 | 58.1 | 15 |
| 7 | 90 | 35 | " | " | " | 58.1 | 64.2 | 13 |
| 8 | 95 | 45 | " | " | " | 42.5 | 50.6 | 14 |
| 9 | 60 | 45 | " | " | 7 days | 61.1 | 68.0 | 11 |

Note:
*Bending of 90°, Bending Radius = 1.5t (t = Thickness of Sheet) The test was carried out after 4 hours from water quenching.
**Life to fracture when loading stress of 75% of yield strength to T6-materials in 3.5% NaCl aqueous solution.

EFFECT OF PRODUCTION CONDITIONS

EXAMPLE 6

O-materials of 2 to 5 mm in thickness were prepared from 400 mm thick ingots of alloy No. 1 shown in Table 1 under the conditions shown in Table 10. In all production conditions Nos. 1 to 17, tension of 0.4 kg/mm² was applied to the coiled sheets to be annealed in the annealing step in a continuous annealing furnace.

TABLE 10

| No. | Soaking Conditions | Hot Rolling Conditions | | | Intermediate Annealing* | Cold Rolling Conditions | | Annealing | | | |
|---|---|---|---|---|---|---|---|---|---|---|---|
| | | | | | | | | Rapid Heating Conditions | | | |
| | | Init. Temp. (°C.) | Final Temp. (°C.) | Thickness of Sheet (mm) | | Cold Reduction (%) | Thickness of Sheet (mm) | Av. Heating Rate (°C./min) | Heating** | Cooling Rate | Reheating*** |
| 1 | 470° C. × 24 hr | 430 | 330 | 6 | not done | 33 | 4 | 140 | 470° C. × 3 min | 30° C./min | 300° C. × 1 hr |
| 2 | 470° C. 24 hr | 400 | 300 | 6 | 370° C. × 1 hr | 33 | 4 | 60 | 450° C. × 2 min | 5° C./min | 300° C. × 1 hr |
| 3 | 465° C. × 16 hr | 425 | 310 | 6 | Not done | 50 | 3 | 225 | 470° C. × 3 min | 50° C./min | 330° C. × 1 hr |
| 4 | 475° C. × 16 hr | 425 | 310 | 6 | 390° C. × 1 hr | 50 | 3 | 90 | 480° C. × 30 sec | 50° C./min | 270° C. × 2 hr |
| 5 | 475° C. × 16 hr | 425 | 310 | 6 | 400° C. × 1 hr | 66 | 2 | 500 | 470° C. × 2 min | 10° C./min | 280° C. × 3 hr |
| 6 | 475° C. × 16 hr | 425 | 310 | 6 | 400° C. × 1 hr | 66 | 2 | 80 | 410° C. × | 10° C./min | 280° C. × 3 hr |
| 7 | 470° C. × 16 hr | 440 | 280 | 8 | not done | 50 | 4 | 230 | 480° C. × 1 min | 50° C./min | 470° C. × 1 hr |
| 8 | 470° C. × 16 hr | 400 | 260 | 8 | " | 50 | 4 | 120 | 480° C. × 40 sec | 100° C./min | 470° C. × 1 hr |
| 9 | 470° C. × 16 hr | 440 | 330 | 5 | " | 40 | 3 | 150 | 490° C. × 20 sec | 20° C./hr | not done |
| 10 | 470° C. × 16 hr | 440 | 360 | 5 | " | 40 | 3 | 140 | 455° C. × 2 min | 20° C./hr | " |
| 11 | 470° C. × 12 hr | 435 | 325 | 5 | " | 50 | 2.5 | 300 | 470° C. × 3 min | 20° C./hr | " |
| 12 | 475° C. × 24 hr | 415 | 345 | 5 | 350° C. × 1 hr | 50 | 2.5 | 70 | 415° C. × 8 min | 25° C./hr | " |
| 13 | 475° C. × 24 hr | 415 | 290 | 9 | 400° C. × 1 hr | 66 | 3 | 800 | 460° C. × 4 min | 25° C./hr | " |
| 14 | 475° C. × 24 hr | 415 | 320 | 8 | 400° C. × 1 hr | 75 | 2 | 200 | 460° C. × 5 min | 25° C./hr | " |
| 15 | 470° C. × 16 hr | 420 | 320 | 10 | not done | 50 | 5 | 150 | 470° C. × 3 min | 25° C./hr | " |
| 16 | 470° C. × 16 hr | 420 | 335 | 8 | 400° C. × 1 hr | 63 | 5 | 140 | 440° C. × 7 min | 25° C./hr | " |
| 17 | 470° C. × | 420 | 335 | 15 | 400° C. × 1 hr | 80 | 3 | 215 | 450° × | 30° C./hr | " |

TABLE 10-continued

| No. | Soaking Conditions | Hot Rolling Conditions: Init. Temp. (°C.) | Final Temp. (°C.) | Thickness of Sheet (mm) | Intermediate Annealing* | Cold Rolling Conditions: Cold Reduction (%) | Thickness of Sheet (mm) | Annealing: Rapid Heating Conditions: Av. Heating Rate (°C./min) | Heating** | Cooling Rate | Reheating*** |
|---|---|---|---|---|---|---|---|---|---|---|---|
| | 16 hr | | | | | | | | 2 min | | |

Note:
*Cooling rate after heating is 25° C./hr.
**First stage heating temperature × Holding time
***Second stage heating temperature × Holding time
Cooling rate after reheating is 25° C./hr.

O-materials produced under the conditions of Nos. 1 to 17 shown in Table 10 were further cold worked to a 20% cold reduction which is apt to cause the most grain growth, solution heat treated at 494° C. for 35 minutes in the salt bath and water quenched to provide W-materials.

Table 11 shows properties of the W-materials. The W-materials obtained above were aged at 120° C. for 24 hours to provide T6-materials. Properties of T6-materials are given in Table 11.

TABLE 11

| No. | Result of Bending Test of W-Material*: External Appearance | Occurrence of Crack | Grain Size of W-Material (μm) | Mechanical Properties of T6-Materials: Yield Strength (kg/mm²) | Tensile Strength (kg/mm²) | Elongation (%) |
|---|---|---|---|---|---|---|
| 1 | Good | None | 35 | 52.7 | 57.9 | 14 |
| 2 | " | " | 40 | 52.7 | 57.5 | 14 |
| 3 | " | " | 35 | 53.1 | 57.5 | 14 |
| 4 | " | " | 35 | 53.1 | 57.5 | 15 |
| 5 | " | " | 40 | 53.1 | 57.5 | 15 |
| 6 | " | " | 45 | 52.1 | 57.1 | 15 |
| 7 | " | " | 30 | 52.5 | 57.9 | 15 |
| 8 | " | " | 50 | 52.9 | 57.9 | 14 |
| 9 | " | " | 40 | 51.9 | 57.9 | 14 |
| 10 | " | " | 35 | 51.9 | 57.9 | 14 |
| 11 | " | " | 35 | 52.8 | 57.7 | 13 |
| 12 | " | " | 45 | 52.8 | 57.7 | 13 |
| 13 | " | " | 35 | 52.8 | 57.6 | 14 |
| 14 | " | " | 35 | 52.6 | 57.6 | 14 |
| 15 | " | " | 35 | 52.6 | 57.6 | 14 |
| 16 | " | " | 40 | 52.9 | 57.6 | 14 |
| 17 | " | " | 35 | 52.6 | 57.8 | 15 |

Note:
*Bending of 90°, Bending Radius = 1.5t (t = Thickness of Sheet) The test was carried out after 4 hours from the water quenching.

As can be seen from the above Table 11, all W-materials of the present invention had a fine grain size not exceeding 100 μm and grain growth was hardly detected after water quenching conducted after cold working. Further, both the W-materials and T6-materials proved to have excellent properties as aircraft stringer and stringer frame materials. In Table 11, the results of the case of 20% cold reduction are given, but also, in the cases of the other reductions ranging from 0 to 80%, fine grain sizes not exceeding 100 μm could be obtained in the produced materials in the solution condition and both W-materials and T6-materials exhibited sufficiently improved properties as aircraft stringer and stringer frame materials.

What is claimed is:

1. A method for producing a fine-grained, high strength aluminum alloy material having a grain size not exceeding 100 μm comprising the steps of:

homogenizing an aluminum base alloy consisting essentially of 5.1 to 8.1 wt.% Zn, 1.8 to 3.4 wt.% Mg, 1.2 to 2.6 wt.% Cu, up to 0.2 wt.% Ti and at least one of 0.18 to 0.35 wt.% Cr and 0.05 to 0.25 wt.% Zr, the balance being aluminum and impurities;

hot rolling said alloy while coiling said alloy to form a hot rolled coiled alloy sheet;

cold rolling said coiled sheet to a given thickness;

annealing said coiled sheet in a continuous annealing furnace by rapidly heating said coiled sheet to a temperature of 400° to 500° C. at an average heating rate exceeding 50° C./min, maintaining said coiled sheet at said temperature for a period of 10 seconds to 10 minutes, said coiled sheet being kept under stress by applying a tension not exceeding 2 kg/mm² thereto during said annealing step;

cold working said sheet to a rolling reduction of 0 to 90%; and solution heat treating said sheet.

2. A method according to claim 1, wherein said impurities are limited within the ranges of up to 0.50 wt.% Fe, up to 0.40 wt.% Si and up to 0.70 wt.% Mn.

3. A method according to claim 1, wherein in said annealing step, said step of maintaining said coiled sheet at said temperature of 400° to 500° C. is followed by a step of cooling said coiled sheet at an average cooling rate of less than 30° C./hr.

4. A method according to claim 1, wherein in said annealing step, said step of maintaining said coiled sheet at said temperature of 400° to 500° C. is followed by a step of cooling said coiled sheet at an average cooling rate not less than 30° C./hr.

5. A method according to claim 4, wherein after said cooling step said coiled sheet is reheated to a temperature of 260° to 350° C., and then cooled at an average cooling rate not greater than 30° C./hr.

6. A method according to claim 5, wherein said sheet is air-cooled after said reheating step.

7. A method according to claim 1, wherein said homogenization step is conducted at a temperature in the range of 400° C. to 490° C. for 2 to 48 hours, said hot rolling step is initiated at a temperature in the range of 350° C. to 470° C., and said cold rolling step results in rolling reduction of at least 20%.

8. A method according to claim 1, wherein said tension is in the range of 0.2 to 2 $Kg/mm^2$.

9. A method according to claim 7, wherein Zn, Mg and Cu are fully dissolved in said alloy during said homogenization step, and at least one of said Zr and Cr precipitates to form fine intermetallic compound.

10. A method according to claim 1 or claim 7, including a step of annealing said coiled sheet following said hot rolling step by maintaining said coiled sheet at a temperature of from 300° C. to 460° C. and then cooling said coiled sheet at a rate not exceeding 30° C./hr.

* * * * *